US010604717B2

(12) United States Patent
Lerasle et al.

(10) Patent No.: US 10,604,717 B2
(45) Date of Patent: Mar. 31, 2020

(54) LUBRICANT COMPOSITION FOR AN ENGINE

(71) Applicants: TOTAL MARKETING SERVICES, Puteaux (FR); DOW GLOBAL TECHNOLOGIES LLC, Midland, MI (US)

(72) Inventors: Olivier Lerasle, Lyons (FR); Jérôme Valade, Lyons (FR); Nadjet Khelidj, Horgen (CH)

(73) Assignees: Total Marketing Services, Puteaux (FR); Dow Global Technologies LLC, Midland, MI (US)

( * ) Notice: Subject to any disclaimer, the term of this patent is extended or adjusted under 35 U.S.C. 154(b) by 64 days.

(21) Appl. No.: 14/398,641

(22) PCT Filed: May 3, 2013

(86) PCT No.: PCT/EP2013/059267
§ 371 (c)(1),
(2) Date: Nov. 3, 2014

(87) PCT Pub. No.: WO2013/164457
PCT Pub. Date: Nov. 7, 2013

(65) Prior Publication Data

US 2015/0126419 A1 May 7, 2015

(30) Foreign Application Priority Data

May 4, 2012 (FR) ..... 12 54149

(51) Int. Cl.
*C10M 163/00* (2006.01)
*C08G 63/00* (2006.01)
*C10M 161/00* (2006.01)

(52) U.S. Cl.
CPC .. *C10M 161/00* (2013.01); *C10M 2203/1025* (2013.01); *C10M 2205/02* (2013.01); *C10M 2205/022* (2013.01); *C10M 2205/028* (2013.01); *C10M 2205/04* (2013.01); *C10M 2209/084* (2013.01); *C10M 2209/105* (2013.01); *C10M 2215/064* (2013.01); *C10M 2219/068* (2013.01); *C10M 2223/045* (2013.01); *C10N 2230/02* (2013.01); *C10N 2230/06* (2013.01); *C10N 2240/10* (2013.01); *C10N 2240/102* (2013.01); *C10N 2240/104* (2013.01)

(58) Field of Classification Search
CPC ..... C10M 135/18; C10M 2219/068; C10M 145/26; C10M 145/32
USPC ..... 508/494, 364
See application file for complete search history.

(56) References Cited

U.S. PATENT DOCUMENTS

| | | | |
|---|---|---|---|
| 4,072,619 | A | 2/1978 | Williams et al. |
| 5,627,146 | A | 5/1997 | Tanaka et al. |
| 5,707,942 | A | 1/1998 | Arai et al. |
| 6,110,878 | A | 8/2000 | McConnachie et al. |
| 6,458,750 | B1 | 10/2002 | Dardin et al. |
| 7,402,800 | B2 | 7/2008 | Delvigne et al. |
| 7,662,881 | B2 | 2/2010 | Walton et al. |
| 8,334,245 | B2 | 12/2012 | Lancon et al. |
| 8,357,644 | B2 | 1/2013 | Thoen et al. |
| 8,486,878 | B2 | 7/2013 | Li Pi Shan et al. |
| 8,492,322 | B2 | 7/2013 | Li Pi Shan et al. |
| 8,592,357 | B2 | 11/2013 | Thoen et al. |
| 8,609,597 | B2 | 12/2013 | Greaves et al. |
| 8,664,169 | B2 | 3/2014 | Bouffet |
| 9,957,462 | B2 | 5/2018 | Guerin et al. |
| 9,973,266 | B1 | 5/2018 | Avellan et al. |
| 2003/0022954 | A1 | 1/2003 | Masawaki |
| 2005/0107269 | A1 | 5/2005 | Yagishita et al. |
| 2006/0116298 | A1 | 6/2006 | Chambard et al. |
| 2009/0093384 | A1 | 4/2009 | Ward et al. |
| 2009/0163392 | A1 | 6/2009 | Boffa et al. |

(Continued)

FOREIGN PATENT DOCUMENTS

| | | | |
|---|---|---|---|
| CA | 2034144 | A1 | 7/1991 |
| EP | 0438709 | A1 | 7/1991 |

(Continued)

OTHER PUBLICATIONS

Office Action dated Jan. 17, 2017 by the Japanese Patent Office for the Japanese Patent Application No. 2015-509451, and an English Translation of the Office Action (8 pages).

(Continued)

*Primary Examiner* — Prem C Singh
*Assistant Examiner* — Francis C Campanell
(74) *Attorney, Agent, or Firm* — Harness, Dickey & Pierce, PLC

(57) ABSTRACT

The present disclosure relates to lubricant compositions for an engine, including at least one base oil, at least one polymer for improving the viscosity index, at least one organomolybdenum compound, and at least one polyalkylene glycol, obtained by polymerizing or copolymerizing alkylene oxides including from 3 to 8 carbon atoms, at least of which is butylene oxide, the polyalkylene glycol content being from 1 to 28% by weight relative to the total weight of lubricant composition. The use of at least one polyalkylene glycol, obtained by polymerizing or copolymerizing alkylene oxides including 3 to 8 carbon atoms, at least one of which is butylene oxide, in a base oil enables a reduction in the wear of the connecting-rod bearings of the thermal internal combustion engines of vehicles with hybrid and/or micro-hybrid engines.

20 Claims, No Drawings

(56) References Cited

U.S. PATENT DOCUMENTS

| | | | | |
|---|---|---|---|---|
| 2009/0203561 | A1 | 8/2009 | Kamano | |
| 2010/0041572 | A1 | 2/2010 | Sano et al. | |
| 2010/0075875 | A1* | 3/2010 | Yaguchi | C10M 169/04 508/192 |
| 2011/0059877 | A1 | 3/2011 | Obiols et al. | |
| 2011/0098204 | A1 | 4/2011 | Patil et al. | |
| 2011/0306527 | A1 | 12/2011 | Bouffet et al. | |
| 2012/0108482 | A1* | 5/2012 | Greaves | C10M 107/34 508/579 |
| 2012/0184473 | A1 | 7/2012 | Boffa et al. | |
| 2012/0264666 | A1 | 10/2012 | Donnelly et al. | |
| 2013/0096041 | A1 | 4/2013 | Matray et al. | |
| 2013/0157909 | A1 | 6/2013 | Greaves et al. | |
| 2013/0178402 | A1 | 7/2013 | Chauveau et al. | |
| 2013/0244917 | A1 | 9/2013 | Obrecht et al. | |
| 2013/0281331 | A1 | 10/2013 | Bardin | |
| 2014/0018272 | A1 | 1/2014 | Thoea et al. | |
| 2014/0018273 | A1 | 1/2014 | Zweifel et al. | |
| 2014/0235516 | A1 | 8/2014 | Lancon | |
| 2015/0119303 | A1 | 4/2015 | Guerin et al. | |
| 2016/0130521 | A1 | 5/2016 | Lerasle et al. | |

FOREIGN PATENT DOCUMENTS

| | | | |
|---|---|---|---|
| EP | 0719851 | A2 | 7/1996 |
| EP | 0743354 | A1 | 11/1996 |
| EP | 0757093 | A1 | 2/1997 |
| EP | 1013749 | A2 | 6/2000 |
| EP | 0822246 | B1 | 10/2000 |
| EP | 2078745 | A1 | 7/2009 |
| JP | S54159411 | A | 12/1979 |
| JP | S6088094 | A | 5/1985 |
| JP | H093463 | A | 1/1997 |
| JP | 201105759 | A | 3/2011 |
| WO | WO-9826030 | A1 | 6/1998 |
| WO | WO-03008428 | A1 | 1/2003 |
| WO | WO-2005113640 | A1 | 12/2005 |
| WO | WO-2007096719 | A1 | 8/2007 |
| WO | WO-2009134716 | A1 | 11/2009 |
| WO | WO-2010046620 | A1 | 4/2010 |
| WO | WO-2010114209 | A1 | 10/2010 |
| WO | WO 2011011656 | A2 * | 1/2011 ..... C10M 107/34 |
| WO | WO-2012030537 | A1 | 3/2012 |
| WO | WO-2012040174 | A1 | 3/2012 |
| WO | WO-2012070007 | A1 | 5/2012 |

OTHER PUBLICATIONS

Office Action dated Apr. 26, 2017 by the Russian Patent Office for the Russian Patent Application No. 2014147250/04(076039), and an English Translation of the Office Action (10 pages).

Rounds, Fred, "Effects of Organic Molybdenum Compounds on the Friction and Wear Observed with ZDP-Containing Lubricant Blends." Tribology Transactions, vol. 33, No. 2, Presented at the 35th STLE/ASME Tribology Conference in Fort Lauderdale, Florida, XP007916401, Oct. 16-19, 1989, pp. 345-354.

"UCON™ OSP Base Fluids" Brochure, DOW, XP055034465, Feb. 28, 2011, 4 pages.

* cited by examiner

LUBRICANT COMPOSITION FOR AN ENGINE

CROSS-REFERENCE TO RELATED APPLICATIONS

This application is a National Phase Entry of International Application Serial No. PCT/EP2013/059267, filed on May 3, 2013, which claims priority to French Patent Application Serial No. 1254149, filed on May 4, 2012, both of which are incorporated by reference herein.

TECHNICAL FIELD

The present invention relates to the lubrication of engines of vehicles with hybrid engine and vehicles with micro-hybrid engine, in particular vehicles with micro-hybrid engine equipped with the "Stop-and-Start" system.

BACKGROUND

Environmental concerns and the search for savings in fossil energy resources have led to the development of vehicles with electric motors. However, the latter are limited in terms of power and range, and require a very long battery recharging time.

Hybrid engine systems remedy these drawbacks by utilizing an electric motor and a standard thermal internal combustion engine in series, in parallel or in combination. In a hybrid vehicle, starting is ensured by the electric motor. Up to a speed of the order of 50 km/h, it is the electric motor which provides the driving power of the vehicle. From the moment that a higher speed is reached or a high acceleration is required, the thermal internal combustion engine takes over. When the speed reduces or during vehicle stops, the thermal internal combustion engine stops and the electric motor takes over. Thus, the thermal internal combustion engines of hybrid vehicles are subjected to a significant number of stops and restarts compared to a thermal internal combustion engine of conventional vehicles.

Moreover, certain vehicles are equipped with the "Stop-and-Start" system also called automatic stop and restart device. These vehicles are generally considered as "micro-hybrid" vehicles. In fact, these vehicles are equipped with a thermal internal combustion engine and a starter-alternator or a heavy-duty starter which ensures the stopping and restarting of the thermal internal combustion engine when the vehicle is at a standstill. The thermal internal combustion engines of micro-hybrid vehicles equipped with the "stop-and-start" system, like the thermal internal combustion engines of hybrid vehicles, are therefore subjected to a significant number of stops and restarts compared to thermal internal combustion engines of conventional vehicles.

Thus, over its lifetime, the thermal internal combustion engine of a hybrid vehicle or micro-hybrid vehicle is subjected to a much larger number of stops and starts than that of a standard vehicle. This potentially produces specific wear problems for the thermal internal combustion engines of hybrid and micro-hybrid vehicles, in particular over the long term. These specific wear problems are in particular visible on the connecting rod bearings. There is therefore a need to develop novel lubricant compositions allowing the reliable operation of the internal combustion engines of hybrid and micro-hybrid vehicles equipped with the Stop-and-Start system, and in particular capable of reducing wear, in particular wear on the bearings, in particular wear on the connecting rod bearings in the thermal internal combustion engines of said vehicles.

Surprisingly, the Applicant has found that the use of certain polyalkylene glycols in the thermal internal combustion engines of vehicles with hybrid and micro-hybrid engines equipped with the Stop-and-Start system, makes it possible to considerably reduce wear on the bearings present in said engines, which makes it possible to increase the lifetime of the engine and to increase the time between changes of engine parts. The Applicant company has therefore developed novel lubricant compositions comprising at least one polyalkylene glycol obtained by polymerization or copolymerization of alkylene oxides, including at least one butylene oxide, and also comprising at least one viscosity index improver polymer. Moreover, the quantity of polyalkylene glycol in the lubricant compositions according to the invention is comprised between 1 to 28% by mass, with respect to the total mass of lubricant composition. These particular quantities make it possible to reduce the wear of thermal internal combustion engines. In particular, the compositions according to the invention make it possible to reduce wear on the bearings present in the engines, in particular the engines of vehicles with hybrid engine and vehicles with micro-hybrid engine, including in particular the engines of vehicles with micro-hybrid engine equipped with the "Stop-and-Start" system.

Moreover, the Applicant company has surprisingly found that the combination of these polyalkylene glycols and certain inorganic friction modifiers, in particular organomolybdenum compounds, advantageously makes it possible to reduce wear on the bearings of the engines yet further. Polyalkylene glycols used as lubricant composition additives are known from document WO2011/011656. These compounds have the advantage of being biodegradable and soluble in the four groups of base oils used for the manufacture of lubricant compositions. The document U.S. Pat. No. 6,458,750 describes an engine oil composition with reduced deposit-formation tendency, said composition comprising at least one base oil and at least one alkyl alkoxyalte of formula (I):

$$R_1-[(CR_2R_3)_n]_z-L-A-R_4 \quad (I)$$

wherein $R_1$, $R_2$, $R_3$ represents independently a hydrogen atom or a hydrocarbon group containing up to 40 carbon atoms, $R_4$ is a hydrogen atom or a methyl group or an ethyl group, L is a linker group, n is an integer ranging from 4 to 40, A is an alkoxy group with 2 to 25 repeating units, which are derived from ethylene oxide, propylene oxide and/or butylene oxide and comprising homopolymers as well as statistical copolymers of at least two of the said compounds, and z is 1 or 2.

This composition may also comprise a viscosity index improver polymer. However, this document does not describe a lubricating composition for engines comprising at least one organomolybdenum compounds.

The document EP0438709 discloses an engine oil comprising at least one base oil, at least one polymeric viscosity index improver and at least one product resulting from the reaction of alkyl phenols or bisphenol A with at least one butylene oxide or a butylene/propylene oxide for improving piston cleanliness of automobile engines. However, this document does not describe a lubricating composition for engines comprising at least one organomolybdenum compounds. Moreover, none of these documents describe the use of polyalkylene glycols in a lubricant composition for reducing the wear of thermal internal combustion engines of vehicles with hybrid or micro-hybrid engine and in particular for reducing wear on the bearings.

SUMMARY

The invention provides a lubricant composition for engines comprising at least one base oil, at least one viscosity index improver polymer, at least one organomolybdène compound and at least one polyalkylene glycol, obtained by polymerization or copolymerization of alkylene oxides comprising from 3 to 8 carbon atoms, including at least one butylene oxide, the quantity of polyalkylene glycol being from 1 to 28% by mass with respect to the total mass of lubricant composition. Preferably, the lubricant composition comprises from 0.1 to 10% by mass of organomolybdenum compound, preferably from 0.5 to 8%, more preferably from 1 to 5%, with respect to the total mass of lubricant composition. Preferably, the organomolybdenum compound is chosen from the molybdenum dithiocarbamates and/or dithiophosphates, alone or in a mixture. Preferably, the polyalkylene glycol is a copolymer of butylene oxide and propylene oxide.

Preferably, the butylene oxide to propylene oxide mass ratio is of a value of 3:1 to 1:3, preferably of 3:1 to 1:1. Preferably, the polyalkylene glycol has a molar mass measured according to the standard ASTM D4274 ranging from 300 to 1000 grams per mole, preferably from 500 to 750 grams per mole. Preferably, the polyalkylene glycol has a kinematic viscosity at 100° C. measured according to the standard ASTM D445 ranging from 1 to 12 cSt, preferably from 3 to 7 cSt, more preferably from 3.5 to 6.5 cSt.

Preferably, the lubricant composition comprises from 2 to 20% by mass of polyalkylene glycol with respect to the total mass of the lubricant composition, preferably from 3 to 15%, more preferably from 5 to 12%, even more preferably from 6 to 10%. Preferably, the viscosity index improver polymer is selected from the group consisting of the olefin copolymers, the ethylene/alpha-olefin copolymers, styrene/olefin copolymers, the polyacrylates alone or in a mixture. Preferably, the lubricant composition comprises from 1 to 15% by mass of viscosity index improver polymer with respect to the total mass of the lubricant composition, preferably from 2 to 10%, more preferably from 3 to 8%.

In one embodiment, the lubricant composition consists of:

- from 40 to 80% by mass of base oil,
- from 1 to 28% by mass of polyalkylene glycol, obtained by polymerization or copolymerization of alkylene oxides comprising from 3 to 8 carbon atoms, including at least one butylene oxide,
- from 1 to 15% by mass of viscosity index improver polymer,
- from 1 to 15% by mass of additives chosen from the anti-wear additives, detergents, dispersants, anti-oxidants, friction modifiers, pour point depressants, alone or in a mixture,
- from 0.1 to 10% by mass of at least one organomolybdenum compound, the sum of the constituents being equal to 100% and the percentage being expressed with respect to the total mass of lubricant composition.

Another subject of the invention is the use of at least one polyalkylene glycol, obtained by polymerization or copolymerization of alkylene oxides comprising from 3 to 8 carbon atoms, including at least one butylene oxide in a lubricant composition for the lubrication of metal surfaces, polymeric surfaces and/or amorphous carbon surfaces of the thermal internal combustion engines of hybrid and/or micro-hybrid engines. Preferably, in this use, said polyalkylene glycol is combined with at least one organomolybdenum compound. Preferably, this use aims at reducing wear of the thermal internal combustion engine, in particular the wear of the bearings of the thermal internal combustion engine, in particular the wear of the connecting rod bearings of the thermal internal combustion engine.

Another subject of the invention is a method for lubricating at least one part of an engine of a vehicle with hybrid and/or micro-hybrid engine, said method comprising at least one step in which at least one part of said engine, said part comprising at least one metallic surface or polymeric surface and/or amorphous carbon surface, is brought into contact with the lubricant composition as defined above. In an embodiment of said method, the engine part is a bearing, preferably a connecting rod bearing.

DETAILED DESCRIPTION

The present invention relates to the field of lubrication of thermal internal combustion engines of vehicles with hybrid or micro-hybrid engine. By vehicles with hybrid engine is meant here vehicles using two distinct energy storages capable of moving said vehicles. In particular, hybrid vehicles combine a thermal internal combustion engine and an electric motor, said electric motor participating in the driving power of the vehicle. The operating principle of hybrid vehicles is the following:

- during the stationary phases (where the vehicle is immobile), both engines are stopped,
- on starting, it is the electric motor which ensures the setting in motion of the vehicle, up to higher speeds (25 or 30 km/h),
- when higher speeds are reached, the thermal internal combustion engine takes over,
- in the event of high acceleration, both the engines are started up simultaneously, which makes it possible to have accelerations equivalent to that of the engine of the same power, or even greater,
- optionally, during the deceleration and braking phase, the kinetic energy is used to recharge the batteries.

Thus, in hybrid vehicles, in the course of its lifetime the thermal internal combustion engine is subjected to a much more significant number of stops and starts than in a conventional vehicle ("Stop-and-Start" phenomenon). By vehicles with micro-hybrid engine is meant here vehicles comprising a thermal internal combustion engine but no electric motor like the hybrid vehicles, the "hybrid" character being supplied by the presence of the Stop-and-Start system provided by a starter-alternator or a heavy-duty starter which ensure the stopping and starting of the thermal engine when the vehicle is stopped then restarted.

The present invention more preferentially relates to the lubrication of the thermal internal combustion engines of vehicles equipped with hybrid or micro-hybrid systems operating in an urban environment, where the Stop-and-Start phenomenon and the resultant wear are increased. The wear caused by these frequent stops and restarts can be seen on the different parts in contact with the lubricant: piston, piston ring, piston pin, piston pin boss, small end, big end, connecting rod bearings, crankpin, journal, crankshaft bearing, crank bearings or journal bearings or main bearings, chain pin, oil pump gears, gear system, camshaft, camshaft bearing, cam followers, rocker arm roller, hydraulic valve lifters, turbocharger shaft, turbocharger bearing. In a motor vehicle engine there is a static portion comprising the engine block, the cylinder head, the cylinder head gasket, the liner and various parts ensuring the assembly and tightness of these different parts. There is also a mobile part comprising the crankshaft, the connecting rod and its bearings, the piston and its rings.

The role of the connecting rod is to transmit to the crankshaft the forces received by the piston, by converting a reciprocating rectilinear motion into a circular motion in a single direction. A connecting rod comprises two circular bores, one with a small diameter, called the small end, and the other with a large diameter, called the big end. The body of the connecting rod which connects the small end and the big end is situated between these two bores.

The small end is engaged around the piston pin, the friction between the small end and the piston pin being reduced by the interposition between the two mobile parts of a circular ring covered with or constituted by anti-friction metal (bronze for example), or roller bearings (usually needle roller bearings). The big end encloses the crankpin of the crankshaft. The friction between the big end and crankpin assembly is reduced by the existence of a film of oil and the interposition of bearings between the big end and the crankpin. In this case the term big end bearings is used.

The crankshaft is a rotating part. It is put into position and held by a certain number of bearings, called journals. There is therefore a fixed part, the crankshaft bearing, which encloses a mobile part, the crankshaft journal. Lubrication between these two parts is imperative and bearings are put in place in order to make it possible to withstand the forces applied to these bearings. In this case the term journal bearings is used (or crank bearings or main bearings).

The role of the bearing in the case of a big end or of a journal, is to allow the crankshaft to rotate properly. The bearings are thin shells in the form of a half cylinder. These are parts which are severely affected by the lubrication conditions. If there is contact between the bearing and the turning shaft, crankpin or journal, the energy released systematically results in significant wear or engine breakdown. The wear produced can moreover have the effect of amplifying the phenomenon and the severity of the contact.

Within the context of frequent stops and restarts, as is the case for vehicles with hybrid or micro-hybrid engine, the bearings are subjected to frequent rupture and re-formation of the film of oil. Thus at each stop/restart contact occurs between the metal interfaces and it is the frequency of occurrence of these contacts which is problematic for the bearings.

The bearings are subjected to several types of wear in the engines. The different types of wear encountered in the engines are: adhesive wear or wear by metal-metal contact, abrasive wear, corrosive wear, fatigue wear, or complex forms of wear (contact corrosion, cavitation erosion, wear of electric origin). The bearings are in particular subjected to adhesive wear, the invention is more particularly useful for reducing this type of wear but the invention can nevertheless be applied to the other types of wear mentioned above.

The surfaces which are susceptible to wear, in particular the surfaces of bearings, are metallic-type surfaces, or metallic-type surfaces coated with another layer which can be either a polymer, or a layer of amorphous carbon. The wear is produced at the interface between said surfaces which come into contact when the film of oil becomes insufficient.

The metallic-type surface can be a surface constituted by a pure metal such as tin (Sn) or lead (Pb). Most of the time, the metallic-type surface is a metallic-type alloy, based on a metal and at least one other metallic or non-metallic element. A frequently-used alloy is steel, an alloy of iron (Fe) and carbon (C). The bearings used in the automobile industry, are mostly bearings the support of which is made of steel, a support coated or not coated with another metallic alloy.

The other metallic alloys constituting the metallic surfaces according to the invention, are alloys comprising as basic element, tin (Sn), lead (Pb), copper (Cu) or aluminium (Al), cadmium (Cd), silver (Ag) or zinc (Zn) can also be basic elements of the metallic alloys constituting the metallic surfaces according to the invention. To these basic elements other elements chosen from antimony (Sb), arsenic (As), chromium (Cr), indium (In), magnesium (Mg), nickel (Ni), platinum (Pt) or silicon (Si) will be added. Preferred alloys are based on the following combinations Al/Sn, Al/Sn/Cu, Cu/Sn, Cu/Al, Sn/Sb/Cu, Pb/Sb/Sn, Cu/Pb, Pb/Sn/Cu, Al/Pb/Si, Pb/Sn, Pb/In, Al/Si, Al/Pb. The preferred combinations are the combinations Sn/Cu, Sn/Al, Pb/Cu or Pb/Al. Copper- and lead-based alloys are preferred alloys, they are also called copper-lead or white metal alloys.

According to another embodiment, the surfaces affected by wear are polymeric type surfaces. Most of the time, the bearings are made of steel and also comprise this polymeric surface. The polymers which can be used are either thermoplastic materials such as polyamides, polyethylenes, fluoropolymers such as the tetrafluoroethylenes, in particular the polytetrafluoroethylenes (PTFE), or thermosetting materials such as the polyimides, phenolic plastics (or phenol-formaldehyde (PF) resins).

According to another embodiment, the surfaces affected by wear are amorphous carbon type surfaces. Most of the time, the bearings are made of steel and also comprise this amorphous carbon type surface. The amorphous carbon type surfaces are also called DLC, or Diamond Like Carbon or Diamond Like Coating, the carbons of which are $sp^2$ and $sp^3$ hybridizations.

Polyalkylene Glycols

The polyalkylene glycols used in the compositions according to the invention have properties suitable for use in an engine oil. These are (random or block) alkylene oxide polymers or copolymers which can be prepared according to the known methods described in the application WO 2009/134716, page 2 line 26 to page 4 line 12, for example by attack by an alcohol initiator of the epoxy bond of an alkylene oxide and propagation of the reaction.

The polyalkylene glycols (PAGs) of the compositions according to the invention correspond to general formula (A):

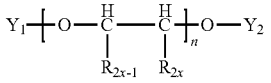

(A)

wherein $Y_1$ and $Y_2$ are, independently of each other, hydrogen, or a hydrocarbon group, for example an alkyl or alkylphenyl group, having 1 to 30 carbon atoms, n represents an integer greater than or equal to 2, preferably less than 60, preferably ranging from 5 to 30, preferably ranging from 7 to 15, x represents one or more integers ranging from 1 to n, the $R_{2x-1}$ and $R_{2x}$ groups are, independently of each other, hydrogen, or hydrocarbon radicals, comprising from 1 to 6 carbon atoms, preferably alkyl groups.

$R_{2x-1}$ and $R_{2x}$ are preferably linear.

Preferably at least one of $R_{2x-1}$ and $R_{2x}$ is hydrogen.

$R_{2x}$ is preferentially hydrogen.

The sum of the numbers of carbon atoms of $R_{2x-1}$ and $R_{2x}$ has a value ranging from 1 to 6.

For at least one value of x, the sum of the numbers of carbon atoms in $R_{2x-1}$ and $R_{2x}$ is equal to 2. The corresponding alkylene oxide monomer is butylene oxide.

The alkylene oxides used for the PAGs of the compositions according to the invention comprise from 3 to 8 carbon atoms. At least one of the alkylene oxides entering into the structure of these PAGs is a butylene oxide, said butylene oxide being 1,2-butylene oxide or 2,3-butylene oxide, preferably 1,2-butylene oxide.

In fact, the PAGs obtained, in part or in whole, from ethylene oxide do not have a sufficiently lipophilic nature to be used in engine oil formulae. In particular, they cannot be used in combination with other mineral, synthetic or natural base oils. Neither is the use of alkylene oxides comprising more than 8 carbon atoms desired as, in order to produce bases having the molar mass and therefore the targeted viscosimetric grade for engine applications, there will then be a reduced number of monomers (low n in formula (A) above), with long $R_{2x-1}$ and $R_{2x}$ side chains. This is detrimental to the overall linear nature of the PAG molecule and leads to viscosity indices (VI) too low for an engine oil application.

Preferably, the viscosity index VI (measured according to the standard NFT 60136) of the PAGs of formula (A) used in the invention is greater than or equal to 100, preferably greater than or equal to 120. In order to confer a sufficiently lipophilic nature upon them, and therefore a good solubility in synthetic base oils, mineral or natural base oils, and good compatibility with certain additives essential to the engine oils, the PAGs according to the invention are obtained from alkylene oxides comprising at least one butylene oxide. Among these PAGs, the butylene oxide (BO) and propylene oxide (PO) copolymers are particularly preferred, as they have both the good tribological and rheological properties of PAGs containing ethylene oxide unites and/or polypropylene, and a good solubility in standard mineral, synthetic, and natural bases, and other oily compounds.

The application WO2011/011656, paragraphs [011] to [014] describes the method of preparation, characteristics, and properties (in particular solubility and miscibility in base oils) of such butylene oxide and propylene oxide copolymer PAGs. These PAGs are prepared by reaction of one or more alcohols with a mixture of butylene oxide and propylene oxide.

In order to confer upon the PAGs a good solubility and good miscibility in mineral, synthetic and natural base oils, it is preferred to use, in the compositions according to the invention, PAGs prepared with a mixture of butylene oxide and propylene oxide where the mass ratio of butylene oxide to propylene oxide is a value of 3:1 to 1:3. The PAGs prepared with a mixture where this ratio is a value of 3:1 to 1:1 are particularly miscible and soluble in base oils, including synthetic oils of Group IV (polyalphaolefins).

According to a preferred embodiment, the PAGs according to the invention are prepared from alcohol comprising from 8 to 12 carbon atoms. 2-ethylhexanol and dodecanol, alone or in a mixture, and in particular dodecanol, are particularly preferred, as the PAGs prepared from these alcohols have very low traction coefficients. According to a preferred embodiment, the PAGs according to the invention are such that their carbon to oxygen molar ratio is greater than 3:1, preferably ranging from 3:1 to 6:1. This confers upon said PAGs polarity and viscosity index properties particularly suitable for use in engine oil.

The molar mass, measured according to the standard ASTM D2502, of the PAGs according to the invention is preferably comprised between 300 and 1000 grams per mole (g/mol), preferably ranging from 350 to 600 g/mol (this is why they contain a limited number of alkylene oxide units n as described above in formula (A)). The molar mass of the PAGs according to the invention measured according to the standard ASTM D4274 preferably has a value ranging from 300 to 1000 grams per mole (g/mol), preferably from 500 to 750 grams per mole. This confers upon them kinematic viscosities at 100° C. (KV100) generally from 1 to 12 cSt, preferably from 3 to 7 cSt, preferably from 3.5 to 6.5 cSt, or from 4 to 6 cSt or from 3.5 to 4.5 cSt. The KV100 of the compositions is measured according to the standard ASTM D445. The use of light PAGs (KV100 approximately from 2 to 6.5 cSt) are preferably chosen in order to be able to more easily formulate multigrade oils of low temperature grade 5W or 0W according to the SAEJ300 classification, as the heavier PAGs have low-temperature properties (high CCS) which do not make it possible to easily achieve these grades.

Lubricant Composition

Another subject of the invention is a lubricant composition for engines, in particular for hybrid or micro-hybrid engines, said lubricant composition comprising at least one base oil and from 1 to 28% by mass of one or more polyalkylene glycols described above, with respect to the total mass of lubricant composition. Preferably, the lubricant compositions according to the invention comprise from 2 to 20% by mass of one or more polyalkylene glycols described above, with respect to the total mass of lubricant composition, more preferably from 3 to 15%, even more preferably from 5 to 12%, even more preferably from 6 to 10%.

Base Oils

The lubricant compositions used according to the present invention comprise one or more base oils, generally representing from 50% to 90% by mass, with respect to the total mass of the lubricant composition, preferably from 60% to 85%, more preferably from 65 to 80%, even more preferably from 70 to 75%. The base oil or oils used in the lubricant compositions according to the present invention can be oils of mineral or synthetic origin from Groups I to V according to the classes defined in the API classification (or their equivalents according to the ATIEL classification) as summarized below, alone or in a mixture. Moreover, the base oil(s) used in the lubricant compositions according to the present invention can be chosen from the oils of synthetic origin of Group VI according to the ATIEL classification.

| | Saturates content | Sulphur content | Viscosity index |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydroisomerized oils | ≥90% | ≤0.03% | ≥120 |
| Group IV | PAO Polyalphaolefins | | |
| Group V | Esters and other bases not included in bases of Groups I to IV | | |
| Group VI* | (PIO) Poly Internal Olefins | | |

*for the ATIEL classification only.

These oils can be oils of vegetable, animal, or mineral origin. The mineral base oils according to the invention include all types of bases obtained by atmospheric and vacuum distillation of crude oil, followed by refining operations such as solvent extraction, deasphalting, solvent dewaxing, hydrotreatment, hydrocracking and hydroisomerization, hydrofinishing. The base oils of the compositions according to the present invention can also be synthetic oils, such as certain esters of carboxylic acids and alcohols, or polyalphaolefins. The polyalphaolefins used as base oils are for example obtained from monomers having 4 to 32 carbon atoms (for example octene, decene), and a viscosity at 100° C. comprised between 1.5 and 15 cSt (ASTM D445). Their average molecular mass by weight is typically comprised between 250 and 3000 (ASTM D5296). Mixtures of synthetic and mineral oils can also be used, for example when multigrade oils are formulated, making it possible to prevent cold-start problems.

Organomolybdenum Compounds

The lubricant compositions according to the invention also comprise at least one inorganic friction modifier chosen from the organomolybdenum compounds. These compounds are, as their name indicates, molybdenum-, carbon- and hydrogen-based compounds, but sulphur and phosphorus are also found in these compounds, and also oxygen and nitrogen. The organomolybdenum compounds used in the compositions according to the invention are, for example, molybdenum dithiophosphates, molybdenum dithiocarbamates, molybdenum dithiophosphinates, molybdenum xanthates, molybdenum thioxanthates, and various organic molybdenum complexes such as molybdenum carboxylates, molybdenum esters, molybdenum amides, which can be obtained by reacting molybdenum oxide or ammonium molybdates with fats, glycerides or fatty acids, or fatty acid derivatives (esters, amines, amides etc.). Organomolybdenum compounds suitable for the lubricant compositions according to the present invention are for example described in application EP2078745, from paragraph [0036] to paragraph [062]. The preferred organomolybdenum compounds are molybdenum dithiophosphates and/or molybdenum dithiocarbamates.

In particular, molybdenum dithiocarbamates have proved very effective in reducing wear on the bearings. The general formula of these molybdenum dithiocarbamates is general formula (I) below in which $R_1$, $R_2$, $R_3$ or $R_4$ are, independently of each other, linear or branched, saturated or unsaturated alkyl groups, comprising from 4 to 18 carbon atoms, preferably from 8 to 13.

(I)

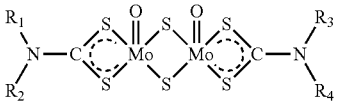

The same is true for the molybdenum dithiophosphates. The general formula of these molybdenum dithiophosphates is general formula (II) below in which $R_5$, $R_6$, $R_7$ or $R_8$ are, independently of each other, linear or branched, saturated or unsaturated alkyl groups, comprising from 4 to 18 carbon atoms, preferably from 8 to 13.

(II)

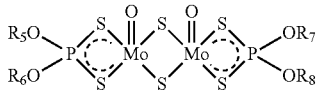

The lubricant compositions according to the invention can comprise between 0.1 and 10% by mass, with respect to the total mass of lubricant composition, of organomolybdenum compound, preferably between 0.5 and 8%, more preferably between 1 and 5%, even more preferably between 2 and 4%.

Surprisingly, the Applicant has demonstrated that the use of the polyalkylene glycols described above in combination with these organomolybdenum compounds, in an engine oil, makes it possible to considerably reduce wear on the connecting rod bearings of the engines of hybrid or micro-hybrid vehicles, without changing the fuel consumption or with reducing the fuel consumption.

The organomolybdenum compounds which can be used in the compositions according to the invention comprise from 1 to 30% by mass of molybdenum, with respect to the total mass of organomolybdenum compound, preferably from 2 to 20%, more preferably from 4 to 10%, even more preferably from 8 to 5%. The organomolybdenum compounds which can be used in the compositions according to the invention comprise from 1 to 30% by mass of sulphur, with respect to the total mass of organomolybdenum compound, preferably from 2 to 20%, more preferably from 4 to 10%, even more preferably from 8 to 5%. The organomolybdenum compounds which can be used in the compositions according to the invention comprise from 1 to 10% by mass of phosphorus, with respect to the total mass of organomolybdenum compound, preferably from 2 to 8%, more preferably from 3 to 6%, even more preferably from 4 to 5%.

Viscosity Index Improver Polymer

The lubricant compositions can comprise at least one or more viscosity index (VI) improver polymers such as for example the Olefin Copolymers (OCP), the ethylene and alpha-olefin copolymers, styrene and olefin copolymers such as the styrene and isoprene copolymers, the polyacrylates such as the polymethacrylates (PMA).

The lubricant compositions according to the present invention can contain of the order of 1 to 15% by mass, with respect to the total mass of the lubricant composition, of at least one viscosity index improver polymer, preferably from 2 to 10%, more preferably from 3 to 8%. Preferably, the lubricant compositions according to the invention preferably have a viscosity index or VI value, measured according to ASTM D2270, greater than 130, preferably greater than 140, preferably greater than 150. Preferably, the lubricant compositions according to the invention have a kinematic viscosity (KV100) at 100° C. according to the standard ASTM D445, comprised between 3.8 cSt and 26.1 cSt, preferably between 5.6 and 12.5 cSt, which according to the SAE J 300 classification corresponds to grades 20 (5.6 to 9.3 cSt) or 30 (9.3 to 12.5 cSt) at high-temperature. Preferably, the lubricant compositions according to the invention are multigrade engine oils of low-temperature grade 0W or 5W, and high-temperature 20 or 30 according to the SAE J 300 classification.

Other Additives

The lubricant compositions for engines used according to the invention can moreover contain all types of additives suitable for use as engine oil. These additives can be introduced in isolation and/or included in additive packages used in the formulations of commercial lubricants, with performance levels as defined by the ACEA (European Automobile Manufacturers' Association) and/or the API (American Petroleum Institute). These additive packages (or additive compositions) are concentrates comprising approximately 30% by weight of dilution base oil.

Thus, the compositions according to the invention can contain in particular and non-limitatively anti-wear and extreme-pressure additives, antioxidants, overbased or non-overbased detergents, pour point improvers, dispersants, anti-foaming agents, thickeners etc. The anti-wear and extreme-pressure additives protect friction surfaces by forming a protective film adsorbed on these surfaces. The most commonly used is zinc dithiophosphate or ZnDTP. Various phosphorus-, sulphur-, nitrogen-, chlorine- and boron-containing compounds are also found in this category.

A great variety of anti-wear additives exists, but the category most frequently used in engine oils is that of the phospho sulphur-containing additives such as metal alkylthiophosphates, in particular zinc alkylthiophosphates, and more specifically zinc dialkyldithiophosphates or ZnDTP. The preferred compounds have the formula $Zn((SP(S)(OR_9)(OR_{10}))_2$, where $R_9$ and $R_{10}$ are linear or branched, saturated or unsaturated alkyl groups, preferably comprising 1 to 18 carbon atoms. The ZnDTP is typically present at levels of the order of 0.1 to 2% by mass, with respect to the total mass of the lubricant composition.

The amine phosphates, polysulphides, in particular sulphur-containing olefins, are also commonly used anti-wear additives. The anti-wear and extreme-pressure additives are generally present in the compositions for engine lubricants at levels comprised between 0.5 and 6% by mass, preferably comprised between 0.7 and 2%, preferably between 1 and 1.5% with respect to the total mass of the lubricant composition. The antioxidants delay the degradation of the oils in service, degradation which can lead to the formation of deposits, the presence of sludge, or an increase in the viscosity of the oil. They act as radical inhibitors or hydroperoxide destroyers. Among the commonly used antioxidants, phenolic and amino-type antioxidants are found.

The phenolic antioxidants can be ash-free, or be in the form of neutral or basic metal salts. Typically, these are compounds containing a sterically hindered hydroxyl group, for example when two hydroxyl groups are in each other's ortho or para position, or the phenol is substituted by an alkyl group comprising at least 6 carbon atoms.

The amino compounds are another class of antioxidants which can be used alone or optionally in combination with the phenolic antioxidants. Typical examples are the aromatic amines of formula $R_{11}R_{12}R_{13}N$, where $R_{11}$ is an aliphatic group, or an optionally substituted aromatic group, $R_{12}$ is an optionally substituted aromatic group, $R_{13}$ is hydrogen, or an alkyl or aryl group, or a group of formula $R_{14}S(O)_xR_{15}$, where $R_{14}$ and $R_{15}$ are alkylene, alkenylene, or aralkylene groups, and x is equal to 0, 1 or 2.

Sulphurized alkylphenols or their alkali and alkaline-earth metal salts are also used as antioxidants. Another class of antioxidants is that of the copper compounds soluble in oil, for example copper thio- or dithiophosphates, copper salts of carboxylic acids, copper dithiocarbamates, sulphonates, phenates, acetylacetonates. Copper (I) and (II) salts of succinic acid or anhydride are used. The antioxidants, alone or in a mixture, are typically present in lubricant compositions for engines in quantities comprised between 0.1 and 5% by mass, preferably between 0.3 and 2% by mass, even more preferably between 0.5 and 1.5% by mass with respect to the total mass of the lubricant composition.

Detergents reduce the formation of deposits on the surface of metal parts by dissolving oxidation and combustion by-products, and allow the neutralization of certain acid impurities originating from the combustion and found in the oil. The detergents commonly used in the formulation of lubricant compositions are typically anionic compounds comprising a long lipophilic hydrocarbon chain and a hydrophilic head. The associated cation is typically a metal cation of an alkali or alkaline-earth metal. The detergents are preferably chosen from the alkali or alkaline-earth metal salts of carboxylic acids, sulphonates, salicylates, naphthenates, as well as the salts of phenates, preferably of calcium, magnesium, sodium or barium.

These metal salts can contain the metal in an approximately stoichiometric quantity or in excess (in a quantity greater than the stoichiometric quantity). In the latter case, we are dealing with so-called overbased detergents. The excess metal providing the detergent with its overbased character is present in the form of metal salts which are insoluble in oil, for example carbonate, hydroxide, oxalate, acetate, glutamate, preferably carbonate, preferably of calcium, magnesium, sodium or barium.

The lubricant compositions according to the present invention can contain all types of detergents known to a person skilled in the art, neutral or overbased. The more or less overbased character of the detergents is characterized by the BN (base number), measured according to the standard ASTM D2896, and expressed in mg of KOH per gram. The neutral detergents have a BN comprised approximately between 0 and 80 mg KOH/g. The overbased detergents, for their part, have BN values typically of the order of 150 mg KOH/g and more, or even 250 mg KOH/g or 450 mg KOH/g or more. The BN of the lubricant composition containing the detergents is measured by the standard ASTM D2896 and expressed in mg of KOH per gram of lubricant. Preferably, the quantities of detergents contained in the engine oils according to the invention are adjusted so that the BN of said oils, measured according to the standard ASTM D2896, is comprised between 5 and less than or equal to 20 mg of KOH per gram of engine oil, preferably between 8 and 15 mg of KOH per gram of engine oil.

The pour point depressant additives improve the low-temperature behaviour of the oils, by slowing down the formation of paraffin crystals. These are for example alkyl polymethacrylates, polyacrylates, polyarylamides, polyalkylphenols, polyalkylnaphthalenes, alkylated polystyrene etc. They are generally present in the oils according to the invention at levels comprised between 0.1 and 0.5% by mass with respect to the mass of lubricant composition.

The dispersants such as for example succinimides, PIB (polyisobutene) succinimides, Mannich bases ensure that the insoluble solid contaminants constituted by the oxidation by-products formed when the engine oil is in service, are maintained in suspension and removed. The dispersant level is typically comprised between 0.5 and 10% by mass, preferably between 1 and 5% with respect to the total mass of the lubricant composition.

Another subject of the invention is a method for lubricating at least one part of an engine of a vehicle with hybrid and/or micro-hybrid engine, said method comprising at least one step in which at least one part of said engine, said part comprising at least one metallic surface or polymeric surface and/or amorphous carbon surface is brought into contact with the lubricant composition as defined above. In an embodiment of said method, the engine part is a bearing, preferably a connecting rod bearing.

The method according to the invention makes it possible to reduce the wear of the internal combustion engine of vehicles with hybrid or micro-hybrid engine. Advantageously, the method according to the invention makes it possible to reduce wear on the bearings, in particular the connecting rod bearings.

EXAMPLES

Aggravated wear on the bearings of an engine equipped with a Stop-and-Start system was simulated by a test consisting of a succession of 12,000 stop/start cycles over 150 hours:

1) Start engine,
2) 10 seconds' operation at idling speed,
3) Stop engine,

Repeat sequence 1 to 3.

The tested system comprises a 4-cylinder diesel engine with a maximum torque of 200 N·m from 1750 to 2500 rpm. It is of the Stop-and-Start type and comprises a starter-alternator between the clutch and the gearbox of the vehicle. The engine oil is maintained at approximately 100° C. in these tests. The wear is monitored by a conventional radiotracer technique, consisting of irradiating the surface of the connecting rod bearings the wear of which is to be tested and, during the test, measuring the increase in radioactivity of the engine oil, i.e. the rate at which the oil is loaded with irradiated metal particles. This rate is directly proportional to the rate of wear on the bearings.

The results are based on the comparative analysis of these damage rates (reference oil and oil to be tested) and are validated by comparison with a reference oil in order to incorporate elements of positive or negative surface adaptation to the damage rate. The damage rates of the tested oils are all compared with the damage rate of the reference oil and quantified in the form of a % ratio of the rate denoted Wear in Table I below.

Lubricant composition A is a reference lubricant composition of grade 5W30. Lubricant compositions B and C are lubricant compositions according to the invention to which a polyalkylene glycol which is a BO/PO (butylene oxide/propylene oxide) PAG having a mass ratio of 50/50, KV100 equal to 6 cSt (measured according to ASTM D445) and molar mass equal to 750 g/mol (measured according to ASTM D4274) has been added. Lubricant composition D is a lubricant composition according to the invention to which the PAG described above and an organomolybdenum compound of general formula (I) with $R_1$, $R_2$, $R_3$, $R_4$ being alkyl groups with 13 and/or 18 carbon atoms, the quantity of molybdenum by mass, with respect to the mass of the compound, is 10%, the quantity of sulphur by mass, with respect to the mass of the compound is 11%, have been added.

Lubricant E is a lubricant composition according to the invention to which the PAG described above and an organomolybdenum compound of general formula (II) with $R_5$, $R_6$, $R_7$, $R_8$ being alkyl groups with 8 carbon atoms, the quantity of molybdenum by mass, with respect to the mass of compound, is 9%, the quantity of sulphur by mass, with respect to the mass of the compound, is 10.1%, the quantity of phosphorus by mass, with respect to the mass of the compound, is 3.2% have been added. Lubricant compositions F and G are control compositions comprising respectively an organomolybdenum compound of general formula (I) and an organomolybdenum compound of general formula (II) as described above.

The compositions by mass and properties of the tested lubricant compositions are summarized in Table I below:

TABLE I

| | A | B | C | D | E | F | G |
|---|---|---|---|---|---|---|---|
| Base oil* | 70% | 68% | 42% | 41% | 41% | 69% | 69% |
| Additive package | 12.3% | 12.3% | 12.3% | 12.3% | 12.3% | 12.3% | 12.3% |
| Polymer | 16.6% | 16.6% | 16.6% | 16.6% | 16.6% | 16.6% | 16.6% |
| Antioxidant | 0.8% | 0.8% | 0.8% | 0.8% | 0.8% | 0.8% | 0.8% |
| PPD | 0.3% | 0.3% | 0.3% | 0.3% | 0.3% | 0.3% | 0.3% |
| PO/BO PAG | — | 2% | 28% | 28% | 28% | — | — |
| MoDTC | — | — | — | 1% | — | 1% | — |
| MoDTP | — | — | — | — | 1% | — | 1% |
| HTHS, mPa · s, ASTM D4741 | 3.5 | 3.5 | 3.5 | 3.5 | 3.5 | 3.5 | 3.5 |
| KV100, cSt, ASTM D445 | 12.0 | 11.8 | 11.9 | 11.8 | 11.7 | 11.8 | 12.1 |
| CCS −30° C., mPa · s, ASTM D5293 | 6360 | 6400 | 6350 | 6340 | 6520 | 6460 | 6490 |
| SAE Grade | 5W30 | 5W30 | 5W30 | 5W30 | 5W30 | 5W30 | 5W30 |
| Wear | 100% | 46% | 57% | 34% | 31% | 51% | 40% |

*excluding dilution base oil in the additive package

The base oil used is a mixture of base oils of Group III, with a viscosity index equal to 171. The viscosity index improver polymer used is a linear styrene/butadiene polymer of mass MW equal to 139 700 (measured according to ASTM D5296), of mass Mn equal to 133 000 (measured according to ASTM D5296) with a polydispersity index equal to 1.1, at 8% of active ingredient in a base oil of Group III.

The antioxidant is an amino antioxidant with an alkylarylamine structure. The PPD or Pour Point Depressant is of polymethacrylate type. The additive package used comprises anti-wear additives, antioxidants, dispersants and standard detergents.

Lubricant composition A is taken as reference. It is found that the use of a polyalkylene glycol in compositions B and C makes it possible to reduce wear. Moreover the combined use of a polyalkylene glycol and an organomolybdenum compound in compositions D and E makes it possible to reduce the level of wear yet further.

The invention claimed is:

1. A lubricant composition for engines equipped with a Stop-and-Start system comprising from 40 to 80% by weight of at least one base oil, from 1 to 2.7% by weight of at least one viscosity index improver polymer, the at least one viscosity index improver polymer being styrene/olefin copolymers, from 0.5 to 2% by weight of either a molybdenum dithiocarbamate compound or a molybdenum dithiophosphate compound, and a polyalkylene glycol, obtained by polymerization or copolymerization of alkylene oxides comprising from 3 to 8 carbon atoms, the polyalkylene glycol being a butylene oxide/propylene oxide (BO/PO) polyalkylene glycol, the quantity of the polyalkylene glycol being from 14 to 28% by mass with respect to a total mass of the lubricant composition.

2. The lubricant composition according to claim 1, in which the lubricant composition comprises 1% by mass of the either the molybdenum dithiocarbamate compound or the molybdenum dithiophosphate compound with respect to the total mass of the lubricant composition.

3. The lubricant composition according to claim 1, in which the BO/PO polyalkylene glycol has a BO to PO mass ratio of 3:1 to 1:3.

4. The lubricant composition according to claim 1, in which the polyalkylene glycol has a molar mass measured according to the standard ASTM D4274 ranging from 300 to 1000 grams per mole.

5. The lubricant composition according to claim 1, in which the polyalkylene glycol has a kinematic viscosity at 100° C. measured according to the standard ASTM D445 ranging from 1 to 12 cSt.

6. The lubricant composition according to claim 1, comprising from 28% by mass of the polyalkylene glycol with respect to the total mass of the lubricant composition.

7. The lubricant composition according to claim 1, in which the viscosity index improver polymer is selected from the group consisting of the olefin copolymers, the ethylene/alpha-olefin copolymers, styrene/olefin copolymers, the polyacrylates alone or in a mixture.

8. The lubricant composition according to claim 1, comprising from 1.33% by mass of viscosity index improver polymer with respect to the total mass of the lubricant composition.

9. The lubricant composition according to claim 1, consisting of:

from 40 to 80% by mass of base oil;

from 14 to 28% by mass of the polyalkylene glycol;

from 1 to 2.7% by mass of viscosity index improver polymer;

from 1 to 15% by mass of additives chosen from the anti-wear additives, detergents, dispersants, anti-oxidants, friction modifiers, pour point depressants, alone or in a mixture;

from 0.5 to 2% by mass of the either the molybdenum dithiocarbamate compound or the molybdenum dithiophosphate compound; and the sum of the constituents being equal to 100% and the percentage being expressed with respect to the total mass of the lubricant composition.

10. A method for lubricating at least one part of an engine equipped with a Stop-and-Start system, the method comprising:

providing a polyalkylene glycol comprising a butylene oxide/propylene oxide (BO/PO) polyalkylene glycol;

combining the polyalkylene glycol with at least one base oil, at least one viscosity index improver polymer, and either a molybdenum dithiocarbamate compound or a molybdenum dithiophosphate compound to obtain a lubricant composition comprising from 40 to 80% by weight of the at least one base oil, from 1 to 2.7% by weight of the at least one viscosity index improver polymer, the at least one viscosity index improver polymer being styrene/olefin copolymers, from 0.5 to 2% by weight of the either the molybdenum dithiocarbamate compound or the molybdenum dithiophosphate compound, and from 14 to 28% by mass of the polyalkylene glycol, with respect to the total mass of the lubricant composition; and bringing into contact the lubricant composition obtained at the previous step with at least one part of the engine, the part comprising at least one metallic surface or polymeric surface and/or amorphous carbon surface.

11. The method according to claim 10, wherein the part of the engine is a bearing.

12. A method for lubricating at least one part of an engine equipped with a Stop-and-Start system, the method comprising at least one step in which at least one part of the engine, the part comprising at least one metallic surface or polymeric surface and/or amorphous carbon surface is brought into contact with the lubricant composition as defined in claim 1.

13. A method according to claim 12, wherein the part of the engine is a bearing.

14. A method comprising:

reducing wear of an internal combustion engine equipped with a Stop-and-Start system; and contacting at least one part of the engine comprising at least one metallic surface or polymeric surface and/or amorphous carbon surface, with a lubricant composition comprising: from 40 to 80% by weight of at least one base oil, from 1 to 2.7% by weight of at least one viscosity index improver polymer, the at least one viscosity index improver polymer being styrene/olefin copolymers, from 0.5 to 2% by weight of either a molybdenum dithiocarbamate compound or a molybdenum dithiophosphate compound, and a polyalkylene glycol, obtained by polymerization or copolymerization of alkylene oxides comprising from 3 to 8 carbon atoms, the polyalkylene glycol comprising butylene oxide/propylene oxide (BO/PO) polyalkylene glycol, the quantity of the polyalkylene glycol being from 14 to 28% by mass with respect to a total mass of the lubricant composition.

15. The method according to claim 14, wherein the engine part is a bearing which is lubricated.

16. The method according to claim 10, wherein the lubricant composition comprises 41% by weight of the at least one base oil, 1.33% by weight of the at least one viscosity index improver polymer, 1% by weight of either the molybdenum dithiocarbamate compound or the molybdenum dithiophosphate compound, and 28% by weight of the BO/PO polyalkylene glycol.

17. The lubricant composition according to claim 1, wherein the at least one base oil comprises an oil of mineral or synthetic origin from American Petroleum Institute (API) Groups I, II, III, IV, or V or an oil of synthetic origin of the Technical Association of the European Lubricants Industry (ATIEL) Group VI.

18. The lubricant composition according to claim 1, wherein the at least one base oil comprises an American Petroleum Institute (API) Group III oil.

19. The lubricant composition according to claim 1, wherein the BO/PO polyalkylene glycol includes the BO and the PO at a mass ratio of about 50:50.

20. The lubricant composition according to claim 1, wherein the polyalkylene glycol consists of the BO/PO polyalkylene glycol, wherein the BO/PO polyalkylene glycol includes the BO and the PO at a mass ratio of about 50:50.

* * * * *